US011480297B2

(12) United States Patent
Park et al.

(10) Patent No.: US 11,480,297 B2
(45) Date of Patent: Oct. 25, 2022

(54) MEMBRANE BONDING STRUCTURE AND LIQUEFIED GAS STORAGE TANK COMPRISING THE SAME

(71) Applicant: DAEWOO SHIPBUILDING & MARINE ENGINEERING CO., LTD., Geoje-si (KR)

(72) Inventors: Kwang Jun Park, Seoul (KR); Haeng Sung Heo, Seoul (KR); Beom Seok Hwang, Suwon-Si (KR); Joong Kyoo Kang, Geoje-si (KR)

(73) Assignee: Daewoo Shipbuilding & Marine Engineering Co., Ltd., Geoje-si (KR)

( * ) Notice: Subject to any disclaimer, the term of this patent is extended or adjusted under 35 U.S.C. 154(b) by 166 days.

(21) Appl. No.: 16/621,131

(22) PCT Filed: Dec. 29, 2018

(86) PCT No.: PCT/KR2018/016737
§ 371 (c)(1),
(2) Date: Dec. 10, 2019

(87) PCT Pub. No.: WO2019/132535
PCT Pub. Date: Jul. 4, 2019

(65) Prior Publication Data

US 2020/0318790 A1 Oct. 8, 2020

(30) Foreign Application Priority Data

Dec. 29, 2017 (KR) ..... 10-2017-0183492

(51) Int. Cl.
*F17C 1/12* (2006.01)
*B63B 25/16* (2006.01)

(52) U.S. Cl.
CPC ..... *F17C 1/12* (2013.01); *B63B 25/16* (2013.01); *F17C 2201/0157* (2013.01);
(Continued)

(58) Field of Classification Search
CPC ..... F17C 1/12; F17C 2221/033; F17C 2221/035; F17C 2201/0157; B63B 25/16
See application file for complete search history.

(56) References Cited

U.S. PATENT DOCUMENTS 3,150,794 A 9/1964 Schlumberger et al.
3,150,795 A * 9/1964 Etienne ..... F17C 3/025 220/678

(Continued)

FOREIGN PATENT DOCUMENTS

CN 1773159 A 5/2006
CN 103384792 A 11/2013

(Continued)

OTHER PUBLICATIONS

Office Action of corresponding Korean Patent Application No. 10-2017-0183492—5 pages (dated Feb. 19, 2019).

(Continued)

*Primary Examiner* — Stephen J Castellano
(74) *Attorney, Agent, or Firm* — Knobbe Martens Olson & Bear LLP

(57) ABSTRACT

Disclosed is a membrane bonding structure for bonding a membrane for forming a sealed wall between first and second surfaces of a storage tank for storing liquefied gas. The membrane bonding structure may comprise: a planar portion panel installed on the first and second surfaces so as to thermally insulate the storage tank; a bonding panel installed on the boundary portion between the first and second surfaces together with the planar portion panel; a first membrane attached to the planar portion panel on the first surface and to the bonding panel so as to seal the storage tank; and a second membrane attached to the planar portion panel on the second surface and to the bonding panel so as to seal the storage tank. The first membrane and the second (Continued)

membrane may be attached to the bonding panel so as to make no direct connection.

9 Claims, 4 Drawing Sheets

(52) U.S. Cl.
CPC ..... *F17C 2203/0685* (2013.01); *F17C 2221/033* (2013.01); *F17C 2221/035* (2013.01); *F17C 2223/0161* (2013.01)

(56) References Cited

U.S. PATENT DOCUMENTS

| | | | | |
|---|---|---|---|---|
| 4,170,952 | A * | 10/1979 | McCown | F17C 13/001 220/560.08 |
| 2006/0096185 | A1 | 5/2006 | Dhellemmes et al. | |
| 2006/0096209 | A1 | 5/2006 | Dhellemmes et al. | |
| 2016/0069514 | A1 | 3/2016 | Delanoe et al. | |
| 2017/0158291 | A1 * | 6/2017 | Heo | B65D 90/06 |
| 2017/0159888 | A1 * | 6/2017 | Han | B65D 90/06 |

FOREIGN PATENT DOCUMENTS

| | | | |
|---|---|---|---|
| GB | 900268 | A | 7/1962 |
| JP | 2016-520770 | A | 7/2016 |
| KR | 10-2009-0098062 | A | 9/2009 |
| KR | 10-0972653 | B1 | 7/2010 |
| KR | 10-2013-0033526 | A | 4/2013 |
| KR | 10-1335254 | B1 | 12/2013 |
| KR | 10-2015-0076744 | A | 7/2015 |
| KR | 10-1552859 | B1 | 9/2015 |
| KR | 10-2015-0141984 | A | 12/2015 |
| KR | 10-2016-0009744 | A | 1/2016 |
| WO | 2014/167228 | A2 | 10/2014 |
| WO | 2017/068303 | A1 | 4/2017 |

OTHER PUBLICATIONS

Extended European Search Report of European Patent Application No. 18896168.4—7 pages (dated Jul. 26, 2021).
The First Office Action of Chinese Patent Application No. 201880039117.7—14 pages (dated Apr. 30, 2021).
International Search Report dated Apr. 3, 2019 in PCT/KR2018/016737 Filed Dec. 27, 2018.

* cited by examiner

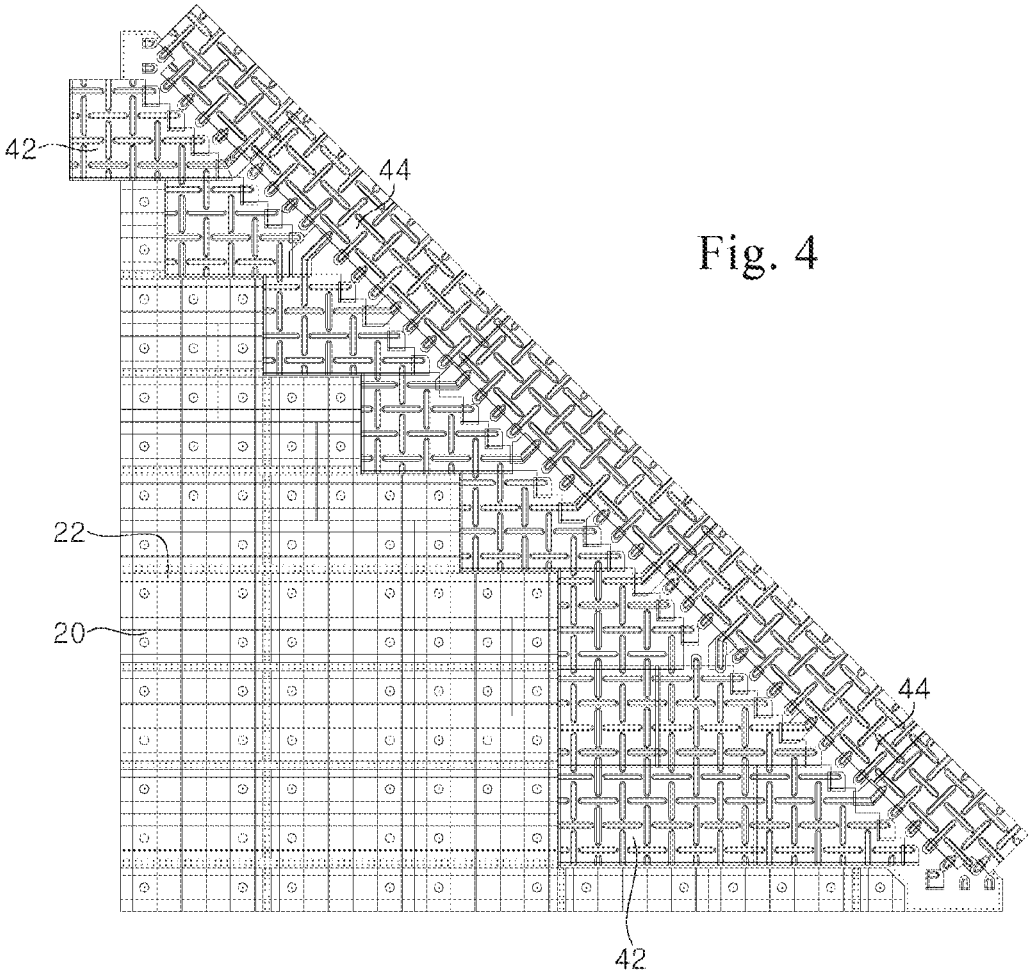
Fig. 4
Fig. 5A
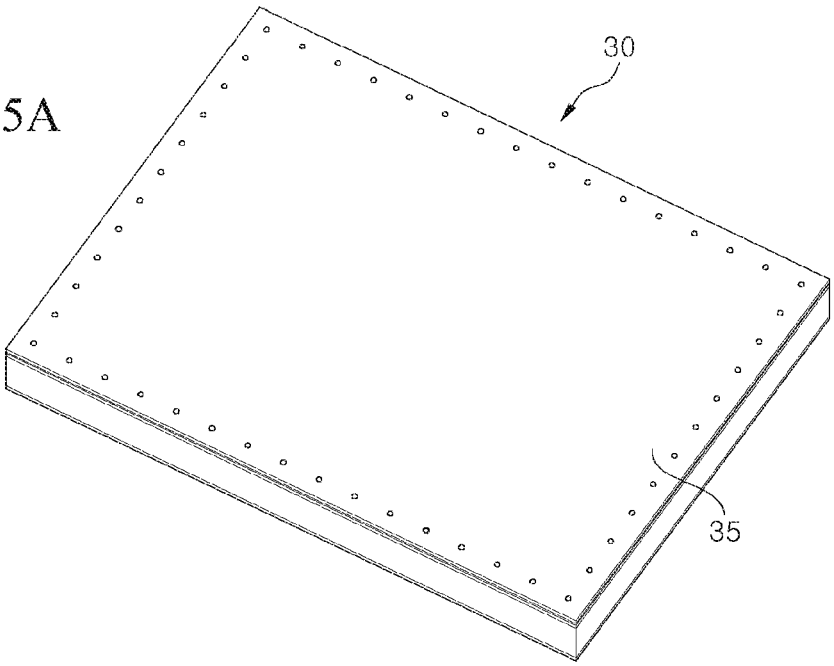

MEMBRANE BONDING STRUCTURE AND LIQUEFIED GAS STORAGE TANK COMPRISING THE SAME

This application is the national stage (Rule 371) of international application No. PCT/KR2018/016737 filed 27 Dec. 2018 and claims foreign priority benefit to Korean application No. KR 10-2017-0183492 filed 29 Dec. 2017.

TECHNICAL FIELD

The present invention relates to a membrane bonding structure provided to a membrane type storage tank to form a primary sealing wall, and more particularly, to a membrane bonding structure provided to a connecting portion between an inclined surface of a storage tank and front and rear surfaces thereof and a liquefied gas storage tank including the same.

BACKGROUND ART

With increasing worldwide interest in eco-friendly businesses, demand for clean fuel capable of replacing existing energy sources, such as oil and coal, is gradually increasing. Under such circumstances, natural gas is used as a main energy source having various advantages including cleanness, safety and convenience in various fields.

Unlike the US or Europe where natural gas is directly supplied to consumers through pipes, some countries including Korea supply natural gas to consumers through liquefaction of natural gas into liquefied natural gas (LNG) having an extremely low temperature and transportation of LNG using an LNG carrier. Accordingly, there is increasing demand for LNG carriers for storage and transportation of LNG corresponding to increasing domestic demand for natural gas.

Natural gas is a fossil fuel mainly consisting of methane and containing small amounts of ethane, propane, and the like, and has recently been spotlighted as a low-pollution energy source in various fields.

Natural gas is transported in a gaseous state through onshore or offshore gas pipelines, or transported to a distant source of demand in the form of LNG by an LNG carrier including an LNG storage tank configured to store LNG. LNG is obtained by cooling natural gas to an extremely low temperature (about −163° C. or less) and is suitable for long-distance transportation by sea since LNG has a volume of about 1/600 that of natural gas in a gaseous state.

An LNG carrier is equipped with a storage tank (also referred to as a 'cargo tank') that can store and retain LNG obtained by cooling and liquefying natural gas. Since the boiling point of LNG is about −162° C. at atmospheric pressure, the storage tank may be formed of materials that can withstand extremely low temperatures, such as aluminum, stainless steel and 35% nickel steel, to safely store and retain LNG and is designed to be resistant to thermal stress and thermal shrinkage while preventing heat intrusion.

LNG carriers for carrying LNG by sea to an onshore source of demand and LNG RVs (regasification vessels) for carrying LNG by sea to an onshore source of demand and unloading natural gas through regasification of the LNG at the onshore source of demand are provided with an LNG storage tank. Recently, floating marine structures, such as LNG FPSO (Floating, Production, Storage and Unloading) and LNG FSRU (Floating Storage and Regasification Unit), also include storage tanks installed on LNG carriers or LNG RVs.

An LNG FPSO is a floating marine structure that is used to store LNG in a storage tank after liquefaction of produced natural gas at sea and to offload the LNG from the storage tank onto an LNG carrier, as needed. An LNG FSRU is a floating marine structure that is used to store LNG unloaded from an LNG carrier in a storage tank at sea far away from the land and to supply the LNG to an onshore source of demand after regasification of the LNG, as needed.

As such, offshore structures for transporting or storing liquid cargo including LNG, such as LNG carriers, LNG RVs, LNG FPSOs, and LNG FSRUs, are provided with a storage tank for storing LNG under cryogenic conditions.

Such storage tanks are classified into an independent type and a membrane type depending upon whether load of a cargo is directly applied to a heat insulator of the storage tank.

A typical membrane type LNG storage tank includes a secondary insulation layer disposed on an inner wall of a hull, a secondary sealing layer disposed on the secondary insulation layer, a primary insulation layer disposed on the secondary sealing layer, and a primary sealing layer disposed on the primary insulation layer.

The heat insulation layers serve to prevent LNG from being heated by external heat by preventing intrusion of the external heat into the cargo tank and the sealing layers serve to prevent leakage of LNG from the storage tank. The cargo tank has a dual sealing structure in order to allow one sealing layer to prevent leakage of LNG even upon damage to the other sealing wall.

For installation of the heat insulation layers and the sealing layers in the LNG storage tank, plural secondary insulation panels are coupled to each other on the inner wall of the hull, the secondary sealing wall is disposed on the plurality of secondary insulation panels, a primary insulation panel is disposed on the secondary sealing wall, and the primary sealing wall is finally disposed on the primary insulation panel.

However, since liquefied gas, such as LNG and the like, is stored in a liquid phase in the storage tank and vessels or floating marine structures are used on the sea generating flow movement, sloshing load caused by the flow of the liquefied gas stored in the storage tank is inevitably applied to the wall of the storage tank.

In general, the membrane type LNG storage tank is designed to have an octagonal column shape corresponding to the sloshing load. In this structure, each corner of an interior hull of the storage tank has an obtuse angle in order to relieve stress concentration. Furthermore, the primary sealing wall has a corrugated membrane structure in order to suppress thermal shrinkage at extremely low temperature in all regions of the cargo tank.

Since the storage tank having an octagonal shape has inclined surfaces between an upper surface and opposite side surfaces thereof and between a lower surface and the opposite side surfaces thereof, the storage tank has a problem of difficulty in uniform connection of membrane sheets having corrugations over all regions of the storage tank.

To overcome such a drawback, in a typical membrane type LNG storage tank, a membrane sheet having corrugations arranged at intervals $2^{1/2}$ times greater than an interval between corrugations of membrane sheets disposed on front and rear surfaces of the storage tank is disposed on an inclined surface of the storage tank and is connected to the membrane sheets on the front (or rear) surface thereof, as shown in FIG. 1.

Referring to FIG. 1, for example, corrugations lines L1, L2 are formed on a rear surface 12 and an upper right-side inclined surface 18 of a liquefied gas storage tank 10, respectively. Assuming the corrugations lines L1 on the rear surface 12 of the storage tank are arranged at an interval a, the corrugations lines L2 on the upper right-side inclined surface 18 are arranged at an interval $a*2^{1/2}$.

However, this structure causes deterioration in structural performance of the membrane sheet, that is, the primary sealing wall.

DISCLOSURE

Technical Problem

Embodiments of the present invention provide a membrane bonding structure, in which bonding panels are provided to connecting portions between an inclined surface of a storage tank and a front surface thereof and between the inclined surface and a rear surface thereof such that an interval between corrugations on the inclined surface of the storage tank can be maintained the same as an interval between corrugations on the front and rear surfaces thereof in formation of a primary sealing wall using a plurality of membranes.

Technical Solution

In accordance with one aspect of the present invention, there is provided a membrane bonding structure for bonding membranes for formation of a sealing wall between a first surface and a second surface of a storage tank for storing liquefied gas, including: a planar portion panel disposed on each of the first surface and the second surface for thermal insulation of the storage tank; a bonding panel disposed on a boundary between the first surface and the second surface together with the planar portion panel; a first membrane attached to the planar portion panel of the first surface and the bonding panel for sealing of the storage tank; and a second membrane attached to the planar portion panel of the second surface and the bonding panel for sealing of the storage tank, wherein the first membrane and the second membrane are attached to the bonding panel so as not to be directly connected to each other.

In one embodiment, one surface of the bonding panel may be finished with a metallic material to allow the first membrane and the second membrane to be joined thereto by welding.

In one embodiment, the bonding panel may include a pair of plywood sheets, a heat insulator interposed between the pair of plywood sheets, a thermal protector stacked on one of the pair of plywood sheets, and an Invar sheet stacked on the thermal protector.

In one embodiment, the pair of plywood sheets may be attached to both surfaces of the heat insulator by a bonding agent, respectively, the thermal protector may be secured to the one plywood sheet by a staple, and the Invar sheet may be secured to the thermal protector by a fastening screw coupled to the one plywood sheet through the thermal protector.

In one embodiment, the bonding panel may be disposed on the boundary between the first surface and the second surface instead of the planar portion panel or by partially removing the planar portion panel for thermal insulation of the storage tank.

In one embodiment, the first surface may be a front surface or a rear surface of the storage tank and the second surface may be an inclined surface of the storage tank.

In one embodiment, a hypotenuse portion may be formed between the front surface and the inclined surface or between the rear surface and the inclined surface, and the bonding panel may be linearly arranged in plural on the hypotenuse portion.

In one embodiment, the first membrane and the second membrane may form a primary sealing layer of the storage tank to directly contact cryogenic liquefied gas and may include a plurality of corrugations to absorb thermal stress resulting from shrinkage and expansion of the cryogenic liquefied gas.

In one embodiment, the membrane bonding structure may further include a connection membrane having corrugations and disposed at an interface between two bonding panels adjoining each other.

In one embodiment, the connection membrane may be bonded to the interface between the two bonding panels to connect the first membrane to the second membrane.

In accordance with another aspect of the present invention, there is provided a storage tank having a polyhedral shape and storing liquefied gas, the storage tank including: a heat insulation layer disposed on an inner wall of a hull; a primary sealing layer disposed on the heat insulation layer and directly contacting the liquefied gas; and a membrane bonding structure for bonding membranes for formation of the primary sealing layer between a first surface and a second surface of the storage tank, wherein the membrane bonding structure includes a planar portion panel disposed on each of the first surface and the second surface for thermal insulation of the storage tank; a bonding panel disposed on a boundary between the first surface and the second surface together with the planar portion panel; a first membrane attached to the planar portion panel of the first surface and the bonding panel for sealing of the storage tank; a second membrane attached to the planar portion panel of the second surface and the bonding panel for sealing of the storage tank, wherein the first membrane and the second membrane are attached to the bonding panel so as not to be directly connected to each other.

Advantageous Effects

Embodiments of the present invention provides a membrane bonding structure including bonding panels capable of attaching membranes disposed at connecting portions between an inclined surface and a front surface of a storage tank and between the inclined surface and a rear surface thereof in formation of a primary sealing wall using a plurality of membranes.

The membrane bonding structure according to the embodiments of the present invention can maintain an interval between corrugations on the inclined surface of the storage tank to be the same as an interval between corrugations on the front and rear surfaces thereof.

In a typical storage tank, since an interval between corrugations formed on membranes for an inclined surface is $2^{1/2}$ times greater than an interval between corrugations formed on membranes for a flat surface, such as a front surface and a rear surface, connection between the corrugations of the membranes for the inclined surface and the corrugations of the membranes for the flat surface causes deterioration in structural performance of the storage tank. In addition, it is necessary to perform separate evaluation on thermal structural performance of the membranes having the corrugations arranged at $2^{1/2}$ times greater intervals for the inclined surface. Moreover, the storage tank requires different kinds of membranes having different intervals of corrugations, thereby providing a negative effect in terms of installation management due to increase in the number of components while increasing manufacturing costs due to manufacture of molds corresponding to different types of corrugations. On the contrary, the membrane bonding structure according to the present invention can advantageously improve performance of the storage tank without the aforementioned disadvantages.

DESCRIPTION OF DRAWINGS

FIG. 4 is a view of the liquefied gas storage tank according to the embodiment of the present invention, illustrating a portion of the corner of the front surface or the rear surface connected to the inclined surface, with membranes for formation of a primary sealing wall locally arranged on the primary insulation panels and bonding panels.

FIG. 5A is a perspective view of a bonding panel capable of attaching membranes.

BEST MODE

Figure 1:
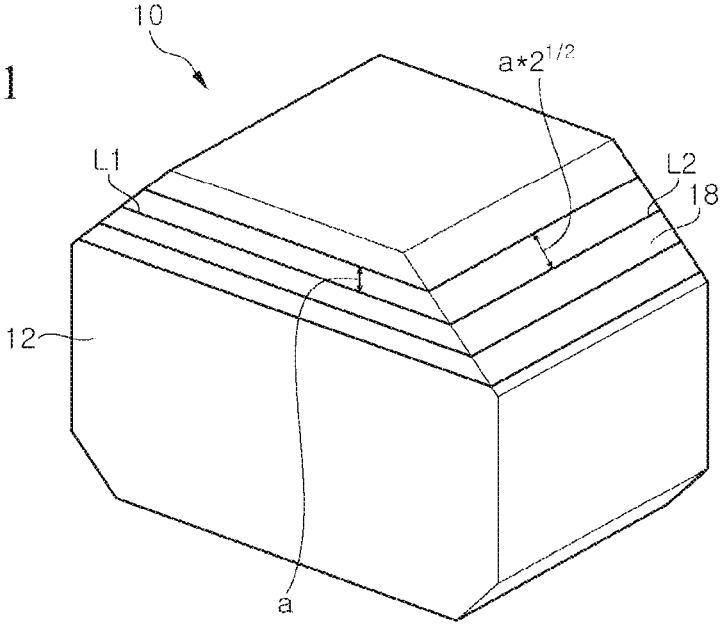
FIG. 1 is a perspective view of a typical liquefied gas storage tank having an inclined surface corresponding to sloshing load.

Hereinafter, exemplary embodiments of the present invention will be described in detail with reference to the accompanying drawings. It should be understood that the present invention is not limited to the following embodiments and can also be implemented in different forms.

A liquefied gas storage tank may be used to store, particularly, a hydrocarbon component-containing liquid cargo, such as LNG, LPG, and the like, which can be liquefied at an extremely low temperature. In addition, the liquefied gas storage tank may be a membrane type storage tank that includes sealing and insulation walls in order to store a cryogenic liquid cargo, such as LNG. The sealing and insulation walls are provided to walls of the storage tank in all directions thereof, that is, a front wall, a rear wall, a left-side wall, a right-side wall, an upper wall, and a lower wall, in order to prevent leakage of liquefied gas stored in the storage tank while blocking heat transfer from an external environment.

The sealing and insulation walls of the membrane type LNG storage tank for storing LNG includes a secondary insulation layer disposed on an inner wall of a hull, a secondary sealing layer disposed on the secondary insulation layer, a primary insulation layer disposed on the secondary sealing layer, and a primary sealing layer disposed on the primary insulation layer.

The insulation layers serve to prevent LNG from being heated by external heat by preventing intrusion of the external heat into the cargo tank and the sealing layers serve to prevent leakage of LNG from the storage tank. The cargo tank has a dual sealing structure so as to allow one sealing layer to prevent leakage of LNG even upon damage to the other sealing wall.

For installation of the sealing and insulation walls of the LNG storage tank, plural secondary insulation panels are coupled to each other on the inner wall of the hull to form a secondary insulation layer, a secondary sealing wall is disposed on the secondary insulation layer formed by the secondary insulation panels to form a secondary sealing layer, a primary insulation panel is disposed on the secondary sealing layer formed by the secondary sealing wall to form a primary insulation layer, and a primary sealing wall (for example, a membrane formed of SUS or the like) is finally disposed on the primary insulation layer formed by the primary insulation panel to form a primary sealing layer.

A liquefied gas storage tank including a primary sealing layer formed using membranes according to one embodiment of the present invention may be disposed inside a hull of a marine structure. Herein, the marine structure includes various liquefied gas carriers such as an LNG carrier, vessels such as LNG RVs (LNG Regasification Vessels), and plants, such as LNG FPSO (LNG Floating, Production, Storage and Off-loading), LNG FSRU (LNG Floating Storage and Regasification Unit), LNG FRU (LNG Floating and Regasification Unit), BMPP (Barge Mounted Power Plant), FSPP (Floating and Storage Power Plant), and the like.

Figure 2:
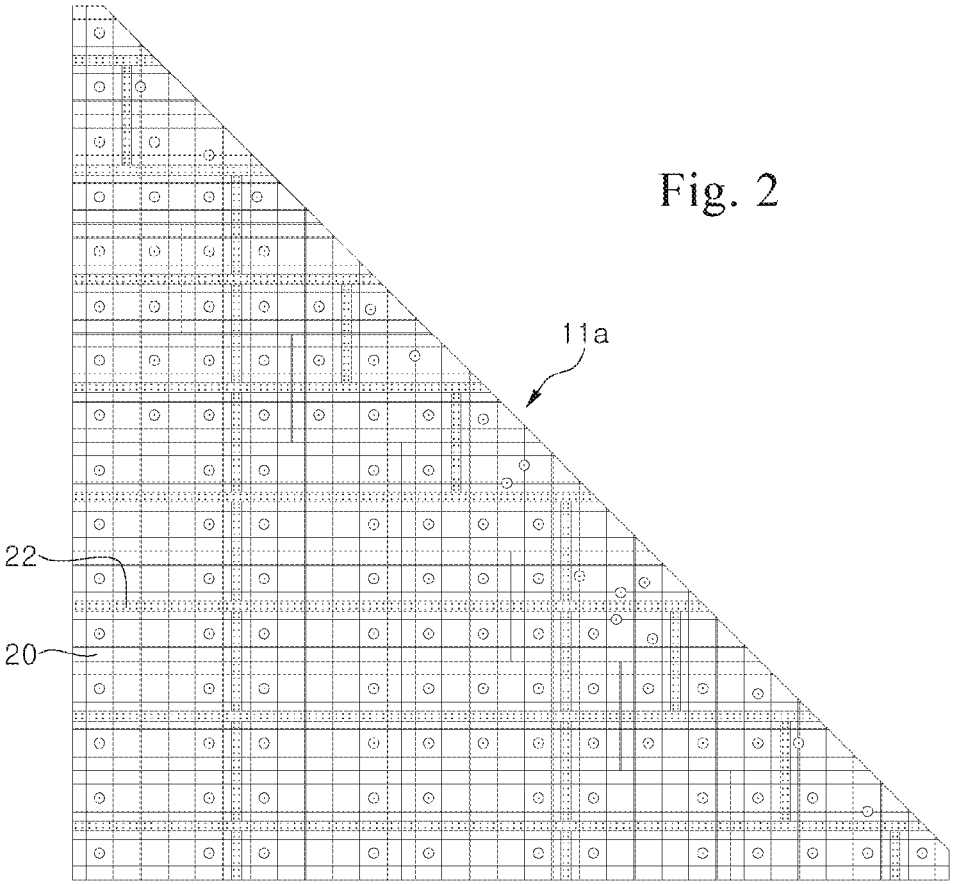
FIG. 2 is a view of a liquefied gas storage tank according to one embodiment of the present invention, illustrating a portion of a corner of a front surface or a rear surface connected to an inclined surface, with primary insulation panels arranged thereon.
Figure 3:
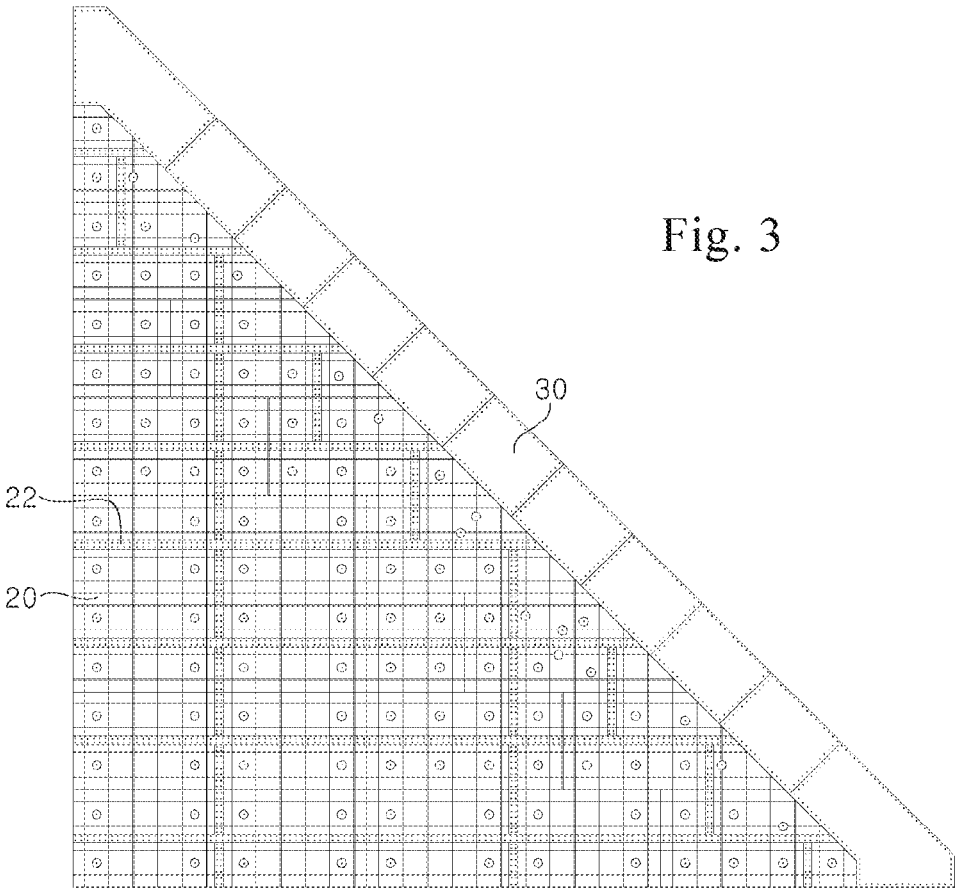
FIG. 3 is a view of the liquefied gas storage tank according to the embodiment of the present invention, illustrating a portion of the corner of the front surface or the rear surface connected to the inclined surface, with bonding panels arranged on the primary insulation panels.

FIG. 2 to FIG. 4 are views of a liquefied gas storage tank according to one embodiment of the present invention, illustrating a portion of a corner of a front surface or a rear surface connected to an inclined surface according to installation sequence in manufacture of the storage tank. FIG. 2 shows primary insulation panels arranged thereon, FIG. 3 shows bonding panels arranged on the primary insulation panels, and FIG. 4 shows membranes for formation of a primary sealing wall locally arranged on the primary insulation panels and bonding panels.

Referring to FIG. 2 to FIG. 4, a membrane bonding structure according to one embodiment of the present invention includes a planar portion panel 20 disposed on an inner wall of the storage tank to form the storage tank, a bonding panel 30 disposed on a hypotenuse portion of a front surface and a rear surface of the storage tank together with the planar portion panel 20, and membranes 42, 44 attached to the bonding panel 30.

The planar portion panel 20 is a portion of a primary insulation panel, which will be disposed in flat regions of the front surface and the rear surface of the liquefied gas storage tank, and forms a primary insulation layer. Herein, the planar portion panel 20 is illustrated as the primary insulation panel for formation of the primary insulation layer. Alternatively, the planar portion panel 20 may be a panel module into which a secondary insulation panel, a secondary sealing wall, and the primary insulation panel are integrated.

The planar portion panel 20 may be, for example, a rectangular parallelepiped plate having a constant thickness and a rectangular shape. One side of the planar portion panel 20 disposed on the hypotenuse portion 11*a* of the front surface and the rear surface of the liquefied gas storage tank may be obliquely cut corresponding to the shape of the hypotenuse portion 11*a*.

FIG. 2 to FIG. 4 shows only a portion of, for example, the front surface of liquefied gas storage tank, in which only one hypotenuse portion 11*a* formed between the front surface and an upper right-side inclined surface thereof is shown. However, it should be noted that the front surface (rear surface) of the liquefied gas storage tank is connected to a total of four inclined surfaces (an upper left-side inclined surface, an upper right-side inclined surface, a lower left-side inclined surface and a lower right-side inclined surface) through the hypotenuse portions and the membrane bonding structure according to the present invention may be applied to all of the hypotenuse portions in the same way.

In addition, a metal strip 22 may be mounted on a surface of the planar portion panel 20 in order to allow the primary sealing wall for formation of the primary sealing wall, that is, the membranes 42, 44, to be easily attached to the planar portion panel 20.

The structure, manufacturing method, and installation method of the planar portion panel 20 do not limit the present invention and detailed description thereof will be omitted.

As shown in FIG. 3, the bonding panel 30 may be disposed on the hypotenuse portion of the front surface and the rear surface of the storage tank. The bonding panel 30 may be linearly arranged in plural along the hypotenuse portion.

Figure 5B:
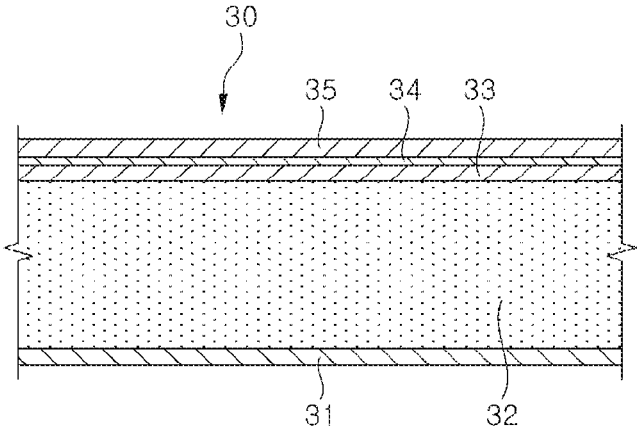
FIG. 5B is a sectional view of the bonding panel capable of attaching membranes.

FIG. 5A and FIG. 5B are a perspective view and a sectional view of the bonding panel 30 to which the membranes 42, 44 are attached, respectively.

As shown in FIG. 3, FIG. 5A and FIG. 5B, the bonding panel 30 may be a portion of the primary insulation panel, which will be disposed in flat regions of the front surface and the rear surface of the liquefied gas storage tank, and may form the primary insulation layer. Herein, the bonding panel 30 is illustrated as being included in the primary insulation panel for formation of the primary insulation layer. Alternatively, the bonding panel 30 may be a panel module into which the secondary insulation panel, the secondary sealing wall, and the primary insulation panel are integrated.

Referring to FIG. 5A, the bonding panel 30 may be, for example, a rectangular parallelepiped plate having a constant thickness and a rectangular shape. Each of the bonding panels 30 disposed at corners of both ends of the hypotenuse portion 11*a* of the front surface and the rear surface of the storage tank may have a shape corresponding to the shape of the corners excluding a rectangular shape.

Referring to FIG. 5B, each of the bonding panels 30 includes a pair of plywood sheets 31, 33, a heat insulator 32 interposed between the plywood sheets 31, 33, a thermal protector 34 stacked on one plywood sheet 33, and an Invar sheet 35 stacked on the thermal protector 34.

The heat insulator 32 may be formed of, for example, polyurethane foam (PUF), reinforced polyurethane foam (RPUF), and the like. The pair of plywood sheets 31, 33 may be attached to both surfaces of the heat insulator 32 via a bonding agent (for example, pu-glue). The thermal protector 34 may be secured to the plywood sheet 33 by a staple. The Invar sheet 35 may be secured to the thermal protector 34 by a fastening screw coupled to the plywood sheet 33 through the thermal protector 34.

The bonding panel 30 may be provided to the secondary insulation panel (not shown) and the secondary sealing wall (not shown) instead of the planar portion panel or may be provided thereto by partially removing the planar portion panel disposed on the secondary insulation panel (not shown) and the secondary sealing wall (not shown).

As shown in FIG. 4, the membranes 42, 44 may be joined to the primary insulation panel, that is, the planar portion panel 20 and the bonding panel 30, by welding. The membranes 42, 44 form the primary sealing layer and directly contact cryogenic liquefied gas. The membranes 42, 44 include a plurality of corrugations 42*a*, 44*a* to absorb thermal stress resulting from shrinkage and expansion of the cryogenic liquefied gas.

FIG. 4 shows the membranes 42, 44 attached to the bonding panel 30, in which the membranes 42, 44 are not stacked in some regions of the planar portion panel 20.

According to the embodiment of the invention, membranes (hereinafter, first membranes 42) to be disposed on the front surface and the rear surface of the storage tank, and membranes (hereinafter, second membranes 44) to be disposed on the inclined surface thereof may be individually bonded to the bonding panel 30 disposed on the hypotenuse portion 11*a*. Thus, according to the embodiment of the invention, the first membranes 42 are not directly connected to the second membranes 44. Furthermore, intervals between corrugations 42*a* on the first membrane 42 do not affect intervals between corrugations 44*a* on the second membrane 44, and the corrugations 42*a*, 44*a* on all of the membranes 42, 44 may be arranged at the same intervals.

According to the present invention, the first membranes 42 and the second membranes 44 may have the same shape and may include the corrugations 42*a*, 44*a* formed in the same pattern.

Although FIG. 4 shows that the first membranes 42 and the second membranes 44 are arranged on the same plane, it should be understood that this arrangement is provided for illustration and convenience of description.

Figure 6:
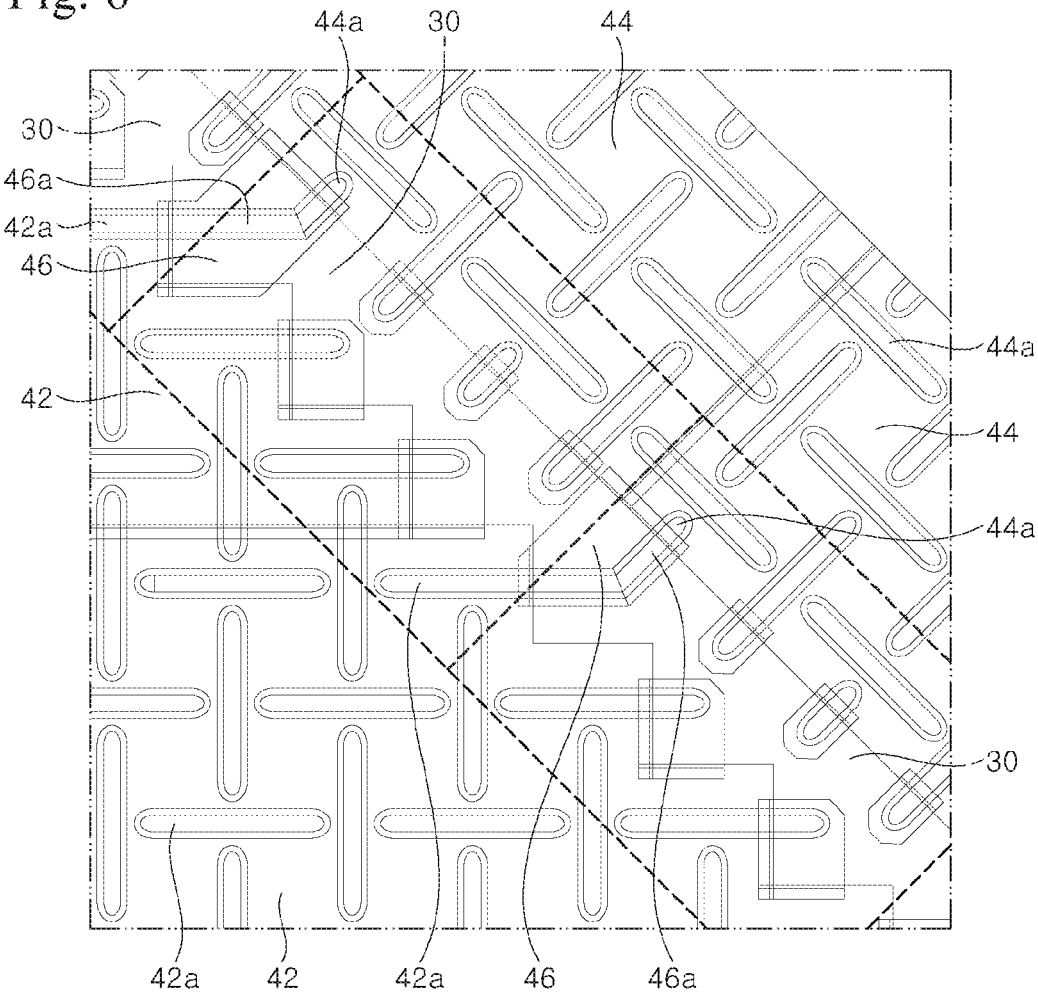
FIG. 6 is a partially enlarged view illustrating arrangement between the bonding panels and the membranes stacked on the bonding panels.

FIG. 6 is a partially enlarged view illustrating arrangement between the bonding panels 30 and the membranes 42, 44 stacked on the bonding panels 30.

As described above, the first membrane 42 and the second membrane 44 are not directly connected to each other and individually bonded to the bonding panel 30. In addition, the corrugations 42*a* formed on the first membrane 42 are not directly connected to the corrugations 44*a* formed on the second membrane 44.

Here, a connection membrane 46 is disposed at an interface between two bonding panels 30 adjoining each other. The connection membrane 46 includes corrugations 46*a*, which connect the corrugations 42*a* of the first membrane 42 to the corrugations 44*a* of the second membrane 44.

The bonding panels 30 are disposed to connect the first membrane 42 to the second membrane 44 at the interface between two bonding panels 30 adjoining each other, whereby the first and second membranes 42, 44 counteract corresponding to thermal deformation of the bonding panels 30, which shrink or expand due to extremely low temperatures of the liquefied gas.

In other words, since the bonding panels 30 shrink towards the center of thermal deformation thereof upon thermal shrinkage, the interface between two bonding panels 30 adjoining each other is subjected to compressive force in opposite directions upon thermal shrinkage. Here, the membranes 42, 44 welded to the bonding panels 30 move corresponding to deformation of the bonding panels 30, thereby causing stress concentration. According to the present invention, stress concentration can be dispersed by the connection membrane 46 including the corrugations 46*a*.

As shown in FIG. 6, the corrugation 46*a* formed on one connection membrane 46 may connect one corrugation 42*a* formed on one first membrane 42, to which the connection membrane 46 is joined, to one corrugation 44*a* formed on one second membrane 44, to which the connection membrane 46 is joined. In FIG. 6, the first membrane 42 and the second membrane 44 are illustrated in a translucent state to confirm the locations of the bonding panels 30 for convenience of understanding.

According to the present invention, the first membranes 42 and the second membranes 44 may be individually bonded to the bonding panels 30 disposed on the hypotenuse portion of the front and rear surfaces, thereby enabling compensation for errors due to manufacturing tolerance of a hull in installation of the membranes of the liquefied gas storage tank.

Although some embodiments are described above with reference to the accompanying drawings, it will be apparent to those skilled in the art that the present invention is not limited to the above embodiments and that various modifications, changes, alterations, and equivalent embodiments can be made without departing from the spirit and scope of the invention.

The invention claimed is:

1. A membrane bonding structure for bonding membranes for formation of a sealing wall between a first surface and a second surface of a storage tank for storing liquefied gas, the membrane bonding structure comprising:

a planar portion panel disposed on each of the first surface and the second surface for thermal insulation of the storage tank;

a bonding panel disposed on a boundary between the first surface and the second surface together with the planar portion panel;

a first membrane attached to the planar portion panel of the first surface and the bonding panel for sealing of the storage tank; and a second membrane attached to the planar portion panel of the second surface and the bonding panel for sealing of the storage tank, wherein the first membrane and the second membrane are attached to the bonding panel so as not to be directly connected to each other, wherein the bonding panel comprises a pair of plywood sheets, a heat insulator interposed between the pair of plywood sheets, a thermal protector stacked on one of the pair of plywood sheets, and an Invar sheet stacked on the thermal protector, and wherein the pair of plywood sheets is attached to both surfaces of the heat insulator by a bonding agent, respectively, the thermal protector is secured to the one of the pair of plywood sheets by a staple, and the Invar sheet is secured to the thermal protector by a fastening screw coupled to the one of the pair of plywood sheets through the thermal protector.

2. The membrane bonding structure according to claim 1, wherein one surface of the bonding panel is finished with a metallic material to allow the first membrane and the second membrane to be joined thereto by welding.

3. The membrane bonding structure according to claim 1, wherein the bonding panel is disposed on the boundary between the first surface and the second surface instead of the planar portion panel or by partially removing the planar portion panel for thermal insulation of the storage tank.

4. The membrane bonding structure according to claim 1, wherein the first surface is a front surface or a rear surface of the storage tank and the second surface is an inclined surface of the storage tank.

5. The membrane bonding structure according to claim 4, wherein a hypotenuse portion is formed between the front surface and the inclined surface or between the rear surface and the inclined surface, and the bonding panel is linearly arranged in plural on the hypotenuse portion.

6. The membrane bonding structure according to claim 1, wherein the first membrane and the second membrane form a primary sealing layer of the storage tank to directly contact cryogenic liquefied gas, and include a plurality of corrugations to absorb thermal stress resulting from shrinkage and expansion of the cryogenic liquefied gas.

7. The membrane bonding structure according to claim 1, further comprising:

a connection membrane having corrugations and disposed at an interface between two bonding panels adjoining each other.

8. The membrane bonding structure according to claim 7, wherein the connection membrane is bonded to the interface between the two bonding panels to connect the first membrane to the second membrane.

9. A storage tank having a polyhedral shape and storing liquefied gas, the storage tank comprising:

a heat insulation layer disposed on an inner wall of a hull;

a primary sealing layer disposed on the heat insulation layer and directly contacting the liquefied gas; and a membrane bonding structure for bonding membranes for formation of the primary sealing layer between a first surface and a second surface of the storage tank, wherein the membrane bonding structure comprises: a planar portion panel disposed on each of the first surface and the second surface for thermal insulation of the storage tank; a bonding panel disposed on a boundary between the first surface and the second surface together with the planar portion panel; a first membrane attached to the planar portion panel of the first surface and the bonding panel for sealing of the storage tank; a second membrane attached to the planar portion panel of the second surface and the bonding panel for sealing of the storage tank, wherein the first membrane and the second membrane are attached to the bonding panel so as not to be directly connected to each other, wherein the bonding panel comprises a pair of plywood sheets, a heat insulator interposed between the pair of plywood sheets, a thermal protector stacked on one of the pair of plywood sheets, and an Invar sheet stacked on the thermal protector, and wherein the pair of plywood sheets is attached to both surfaces of the heat insulator by a bonding agent, respectively, the thermal protector is secured to the one of the pair of plywood sheets by a staple, and the Invar sheet is secured to the thermal protector by a fastening screw coupled to the one of the pair of plywood sheets through the thermal protector.

* * * * *